US012636693B2

(12) United States Patent
Jalluri et al.

(10) Patent No.: US 12,636,693 B2
(45) Date of Patent: May 26, 2026

(54) SYSTEMS AND METHODS FOR MONITORING OBSTRUCTIONS IN A CONDUIT OF A STAMPING ENVIRONMENT

(71) Applicant: Ford Motor Company, Dearborn, MI (US)

(72) Inventors: Chandra Sekhar Jalluri, Canton, MI (US); Brodie Schultz, Ferndale, MI (US); Elizabeth Bullard, Royal Oak, MI (US); Himanshu Rajoria, Canton, MI (US); Yonatan Solomon, Northville, MI (US); James Pelong, Macomb, MI (US); Bryan Barresi, Amherstburg (CA)

(73) Assignee: Ford Motor Company, Dearborn, MI (US)

( * ) Notice: Subject to any disclaimer, the term of this patent is extended or adjusted under 35 U.S.C. 154(b) by 517 days.

(21) Appl. No.: 18/176,743

(22) Filed: Mar. 1, 2023

(65) Prior Publication Data

US 2024/0293856 A1 Sep. 5, 2024

(51) Int. Cl.
*B21C 51/00* (2006.01)
*B21D 22/02* (2006.01)

(52) U.S. Cl.
CPC ..... *B21C 51/00* (2013.01); *B21D 22/025* (2013.01)

(58) Field of Classification Search
USPC ..... 73/649
See application file for complete search history.

(56) References Cited

U.S. PATENT DOCUMENTS 5,170,358 A * 12/1992 Delio ..... G05B 19/4163 702/56
6,114,965 A * 9/2000 Schoch ..... G01H 1/003 73/862.06

(Continued)

FOREIGN PATENT DOCUMENTS

CA 2274470 C * 9/2002 ..... B21D 26/035
CN 206325995 7/2017

(Continued)

OTHER PUBLICATIONS

Adi Otosense, Adi OtoSense™ controls metal scrap evacuation of a stamping press for a European car manufacturer, Product Information pages, 3 pages, Analog Devices, Inc., 2021.

*Primary Examiner* — Walter L Lindsay, Jr.
*Assistant Examiner* — Warren K Fenwick
(74) *Attorney, Agent, or Firm* — Burris Law, PLLC

(57) ABSTRACT

A method includes obtaining stamping system data from a stamping system data controller and vibration data from one or more vibration sensors disposed at the conduit; selecting a baseline vibration threshold and a frequency filter from among a plurality of frequency filters based on the stamping system data; generating a plurality of measured vibration values based on the vibration data and the frequency filter, where each measured vibration value from among the plurality of measured vibration values is associated with a given iteration from among a plurality of iterations of a stamping process; determining whether the conduit is in an obstructed state based on a comparison between a set of measured vibration values from among the plurality of measured vibration values and the baseline vibration threshold; and performing a corrective action in response to the conduit being in the obstructed state.

20 Claims, 4 Drawing Sheets

(56) References Cited

U.S. PATENT DOCUMENTS

| | | | | |
|---|---|---|---|---|
| 7,578,192 | B2 * | 8/2009 | Liasi | B30B 15/0076<br>73/593 |
| 9,149,854 | B2 * | 10/2015 | Zhou | B21D 22/22 |
| 2025/0144697 | A1 * | 5/2025 | Pelong | B21D 37/00 |

FOREIGN PATENT DOCUMENTS

| | | | | | |
|---|---|---|---|---|---|
| CN | 206325995 | U | * | 7/2017 | |
| CN | 109433900 | B | * | 2/2021 | B21D 28/02 |
| CN | 113639853 | | | 11/2021 | |
| CN | 113639853 | A | * | 11/2021 | G01H 11/08 |
| CN | 115301922 | A | * | 11/2022 | B22D 17/32 |

* cited by examiner

SYSTEMS AND METHODS FOR MONITORING OBSTRUCTIONS IN A CONDUIT OF A STAMPING ENVIRONMENT

FIELD

The present disclosure relates to systems and methods for monitoring obstructions in a conduit of a stamping environment.

BACKGROUND

The statements in this section merely provide background information related to the present disclosure and may not constitute prior art.

In a manufacturing environment, stamping dies and tools are used to fabricate various components, such as automotive body structure parts (e.g., a door panel, a hood, among other automotive body structure parts). As an example, a workpiece is provided on a lower die and is pressed by an upper die to form the automotive body structure parts. Excess, removed, or scrap portions of the workpiece resulting from the movement of the upper die are guided into a conveyor system via a conduit to thereby be removed from the manufacturing environment. However, the scrap portions of the workpiece may accumulate and form an obstruction within the conduits, thereby inhibiting the removal of scrap portions from additional workpieces for additional stamping process cycles. Accordingly, failing to detect and address the obstructions within the conduit may inhibit the operation and efficiency of the upper and lower dies during the stamping process. These issues with detecting and addressing obstructions in a conduit during a stamping process, among other issues, are addressed by the present disclosure.

SUMMARY

This section provides a general summary of the disclosure and is not a comprehensive disclosure of its full scope or all of its features.

The present disclosure provides a method for monitoring obstructions of a conduit of a stamping environment. The method includes obtaining stamping system data from a stamping system data controller and vibration data from one or more vibration sensors disposed at the conduit, where the conduit is one of a chute and an evacuation tube; selecting a baseline vibration threshold and a frequency filter from among a plurality of frequency filters based on the stamping system data; generating a plurality of measured vibration values based on the vibration data and the frequency filter, where each measured vibration value from among the plurality of measured vibration values is associated with a given iteration from among a plurality of iterations of a stamping process; determining whether the conduit is in an obstructed state based on a comparison between a set of measured vibration values from among the plurality of measured vibration values and the baseline vibration threshold; and performing a corrective action in response to the conduit being in the obstructed state.

The following paragraph includes variations of the method of the above paragraph, and the variations may be implemented individually or in any combination.

In one form, the stamping system data includes stamping system process identification data; the stamping system data includes stamping system process cycle time data, stamping system process operational data, or a combination thereof; the frequency filter is one of a low-pass filter, a high-pass filter, and a bandpass filter; each measured vibration value from among the plurality of measured vibration values corresponds to a measured vibrational energy of the conduit at the given iteration of the stamping process; the measured vibrational energy is a derivative of a root-mean-square (RMS) of a plurality of vibrational energy values of the conduit at the given iteration; the set of measured vibration values correspond to a set of consecutive iterations from among the plurality of iterations of the stamping process; determining whether the conduit is in the obstructed state based on the comparison between the set of measured vibration values and the baseline vibration threshold further comprises: determining a number of the set of measured vibration values that deviate from the baseline vibration threshold, determining whether the number is greater than an alarm threshold, and determining the conduit is in the obstructed state in response to the number being greater than the alarm threshold; performing the corrective action includes broadcasting a notification, discontinuing the stamping process, or a combination thereof; and/or the corrective action is further based on the stamping system data.

The present disclosure provides a system for monitoring obstructions of a conduit of a stamping environment. The system includes one or more processors and one or more nontransitory computer-readable mediums comprising instructions that are executable by the one or more processors. The instructions include: obtaining stamping system process identification data from a stamping system data controller and vibration data from one or more vibration sensors disposed at the conduit, where the conduit is one of a chute and an evacuation tube; selecting a baseline vibration threshold and a frequency filter from among a plurality of frequency filters based on the stamping system process identification data; generating a plurality of measured vibration values based on the vibration data and the frequency filter, where each measured vibration value from among the plurality of measured vibration values is associated with a given iteration from among a plurality of iterations of a stamping process; determining whether the conduit is in an obstructed state based on a comparison between a set of measured vibration values from among the plurality of measured vibration values and the baseline vibration threshold; and performing a corrective action in response to the conduit being in the obstructed state.

The following paragraph includes variations of the system of the above paragraph, and the variations may be implemented individually or in any combination.

In one form, each measured vibration value from among the plurality of measured vibration values corresponds to a measured vibrational energy of the conduit at the given iteration of the stamping process; the measured vibrational energy is a derivative of a root-mean-square (RMS) of a plurality of vibrational energy values of the conduit at the given iteration; the set of measured vibration values correspond to a set of consecutive iterations from among the plurality of iterations of the stamping process; the instructions for determining whether the conduit is in the obstructed state based on the comparison between the set of measured vibration values and the baseline vibration threshold further comprise: determining a number of the set of measured vibration values that deviate from the baseline vibration threshold, determining whether the number is greater than an alarm threshold, and determining the conduit is in the obstructed state in response to the number being greater than the alarm threshold; the instructions for performing the corrective action includes broadcasting a notification, discontinuing the stamping process, or a combination thereof; and/or the corrective action is further based on the stamping system data.

The present disclosure provides another method for monitoring obstructions of a conduit of a stamping environment. The method includes obtaining stamping system process identification data from a stamping system data controller and vibration data from one or more vibration sensors disposed at the conduit, where the conduit is one of a chute and an evacuation tube; selecting a baseline vibration threshold and a frequency filter from among a plurality of frequency filters based on the stamping system process identification data; generating a plurality of measured vibration values based on the vibration data and the frequency filter, where each measured vibration value from among the plurality of measured vibration values is associated with a given iteration from among a plurality of iterations of a stamping process; determining whether the conduit is in an obstructed state based on a comparison between a set of measured vibration values from among the plurality of measured vibration values and the baseline vibration threshold, where the set of measured vibration values correspond to a set of consecutive iterations from among the plurality of iterations of the stamping process; and performing a corrective action in response to the conduit being in the obstructed state.

The following paragraph includes variations of the method of the above paragraph, and the variations may be implemented individually or in any combination.

In one form, each measured vibration value from among the plurality of measured vibration values corresponds to a measured vibrational energy of the conduit at the given iteration of the stamping process, and the measured vibrational energy is a derivative of a root-mean-square (RMS) of a plurality of vibrational energy values of the conduit at the given iteration; and/or determining whether the conduit is in the obstructed state based on the comparison between the set of measured vibration values and the baseline vibration threshold further comprises: determining a number of the set of measured vibration values that deviate from the baseline vibration threshold, determining whether the number is greater than an alarm threshold, and determining the conduit is in the obstructed state in response to the number being greater than the alarm threshold.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
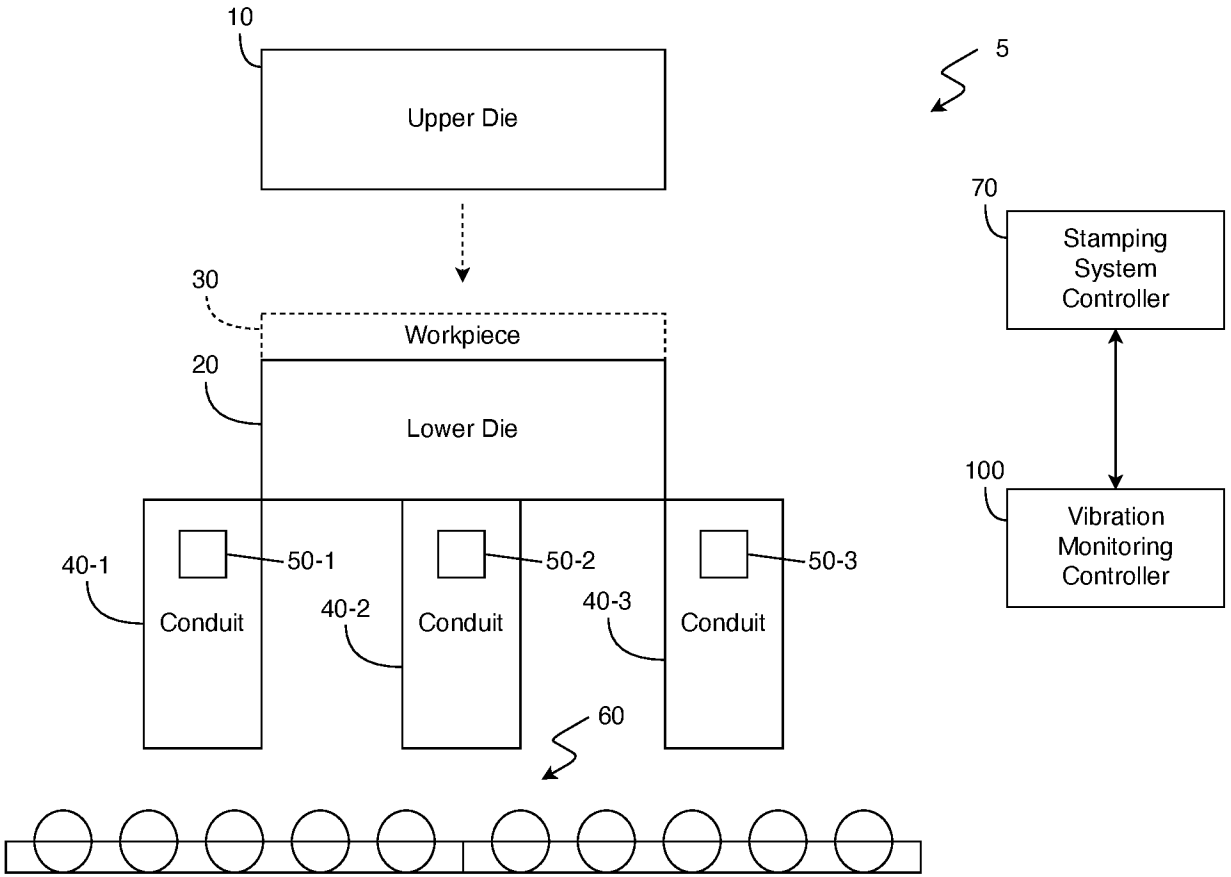
FIG. 1 illustrates an example stamping environment in accordance with the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure provides a method for monitoring obstructions of a conduit of a stamping environment. The method includes obtaining stamping system data, selecting a baseline vibration threshold and a frequency filter from based on the stamping system data, and determining whether the conduit is in an obstructed state based on a comparison between a set of measured vibration values and the baseline vibration threshold. Accordingly, by selecting the appropriate frequency filters and baseline vibration threshold based on the stamping system data, such as data identifying the type of stamping process being performed, the vibration analysis for detecting and addressing obstructions in a conduit of a stamping environment is more accurate and can be uniquely defined for various types of stamping processes.

Referring to FIG. 1, a stamping environment 5 for manufacturing a die (e.g., a stamping die of a vehicle) is shown and generally includes an upper die 10, a lower die 20, a workpiece 30, a first conduit 40-1, a second conduit 40-2, a third conduit 40-3 (collectively referred to hereinafter as "conduits 40"), a first vibration sensor 50-1, a second vibration sensor 50-2, a third vibration sensor 50-3 (collectively referred to hereinafter as "vibration sensors 50"), a conveyor system 60, a stamping system controller 70, and a vibration monitoring controller 100. In one form, the upper die 10, the lower die 20, the vibration sensors 50, the stamping system controller 70, and the vibration monitoring controller 100 are communicably coupled using a wired and/or wireless communication protocol (e.g., a Bluetooth®-type protocol, a cellular protocol, a wireless fidelity (Wi-Fi)-type protocol, a near-field communication (NFC) protocol, an ultra-wideband (UWB) protocol, among others). As used herein, the "conduits 40" refer to enclosed mediums that are configured to transport materials (e.g., scrap portions of the workpiece 30) within the stamping environment 5 and may include, but are not limited to, a chute and an evacuation tube.

In one form, the upper die 10 and lower die 20 are stamping dies that collectively cut and form the workpiece 30 (e.g., sheet metal) into a desired shape, profile, roughness, dimension, among other parameters of the workpiece 30. It should be understood that the upper die 10 and lower die 20 may be provided by other types of dies in other forms, such as drawing dies or casting dies. During operation, the stamping system controller 70 may actuate the upper die 10 to move toward the lower die 20 (as indicated by the dashed arrow) and thereby cut the workpiece 30. The excess, removed, or scrap portions of the workpiece 30 may be guided into the conduits 40 and removed from the manufacturing environment 5 via the conveyor system 60. As described herein, obstructions within the conduits 40 resulting from the excess, removed, or scrap portions of the workpiece 30 may inhibit the efficiency of the stamping process. As such, and as described below in further detail, the vibration monitoring controller 100 is configured to detect the obstructions within the conduits 40 and perform corrective actions to mitigate the obstructions.

In one form, the vibration sensors 50 are disposed at the conduits 40 (e.g., disposed at an external and/or internal surface of the conduits 40) and are configured to generate vibration data associated with the conduits 40. In one form, the vibration data may include any metric indicative of a vibration metric of the conduits 40, such as vibrational energy data, phase data, coherence data, frequency data, and/or amplitude data. The vibration sensors 50 may be provided by an accelerometer, microphones, pressure sensors, and/or types of vibration sensors. It should be understood that the vibration sensors 50 may be provided by any type of sensor configured to generate the vibration data and is not limited to the examples described herein.

In one form, the stamping system controller 70 controls the stamping process performed by the upper die 10 and the lower die 20 and generates stamping system data associated with the stamping process. As an example, the stamping system data includes stamping system process identification data, stamping system process cycle time data, and/or stamping system process operational data. As used herein, "stamping system process identification data" refers to data that identifies the type of stamping process being performed and/or the type of workpiece 30. In one form, the stamping system process identification data is a string of characters or other similar representation that uniquely identifies the stamping process being performed and/or the type of workpiece 30. As used herein, "stamping system cycle time data" refers to data that is indicative of an amount of time employed to perform a stamping operation on the workpiece 30 and dispose the excess, removed, or scrap material within the conduits 40. As used herein, "stamping system process operational data" refers to data that is indicative of any operational characteristic of the stamping process. As an example, the stamping system process operational data may include die sensor data that is indicative of a surface roughness or dimensional parameters (length, width, or area, among other dimensional parameters) of the upper die 10 and/or the lower die 20, temperature data associated with the upper die 10, the lower die 20, and/or the workpiece 30, electrical data associated with the upper die 10 and/or the lower die 20 (e.g., a voltage, current, or power of an actuator that moves the upper die 10), and/or pressure data associated with the upper die 10, the lower die 20, and/or the workpiece 30. As described below in further detail, the vibration monitoring controller 100 may select one or more vibration thresholds and frequency filters based on the stamping system process identification data, the stamping system cycle time data, and/or the stamping system process operational data.

Figure 2:
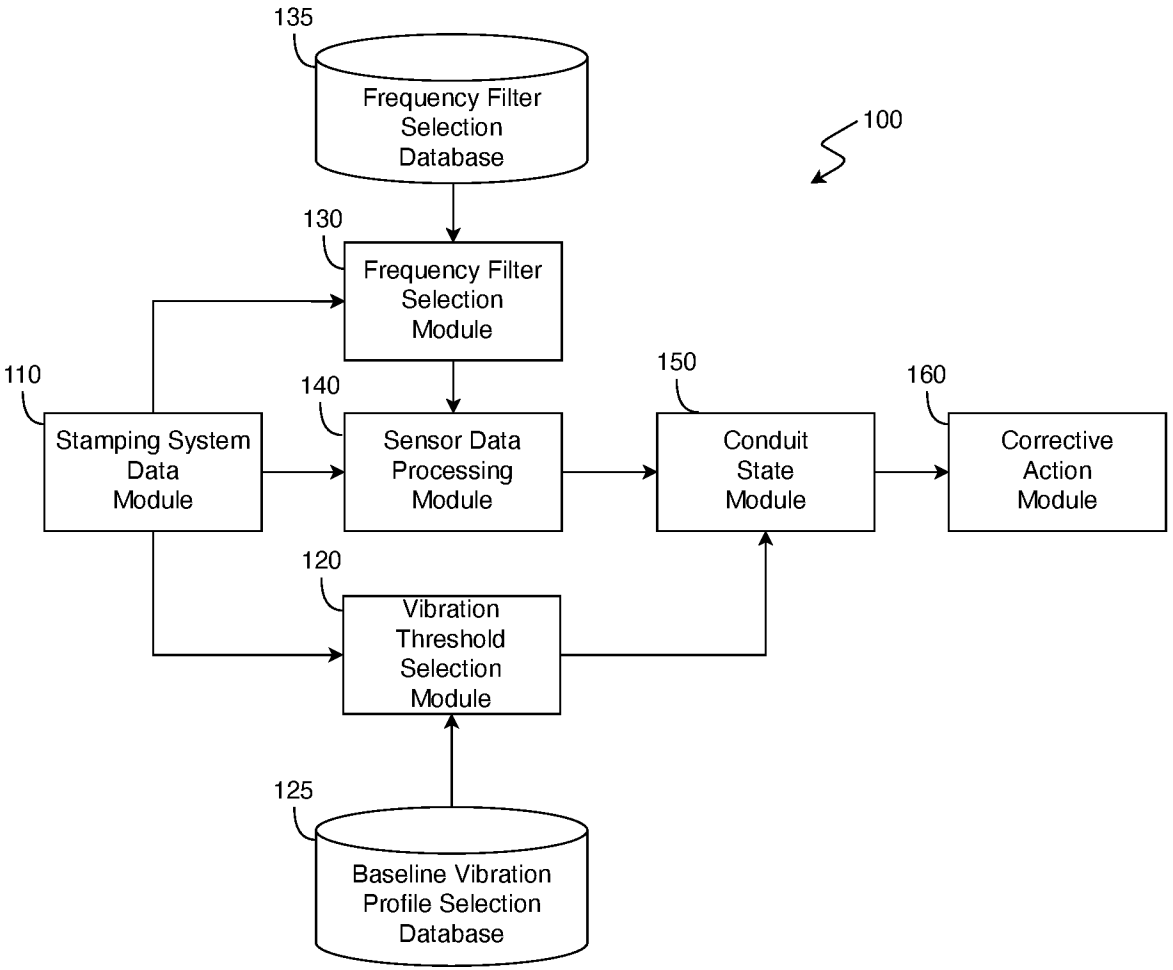
FIG. 2 illustrates an example block diagram of a vibration monitoring controller in accordance with the teachings of the present disclosure.

Referring to FIGS. 1-2, the vibration monitoring controller 100 includes a stamping system data module 110, a vibration threshold selection module 120, a baseline vibration profile selection (BVPS) database 125, a frequency filter selection module 130, a frequency filter selection database 135, a sensor data processing module 140, a conduit state module 150, and a corrective action module 160. In one form, the stamping system data module 110 obtains the stamping system data from the stamping system controller 70 and provides the stamping system data to the frequency filter selection module 130 and the vibration threshold selection module 120. Additionally, the stamping system data module 110 obtains the vibration data the vibration sensors 50 disposed at the conduits 40 and provides the vibration data to the sensor data processing module 140.

In one form, the vibration threshold selection module 120 selects a baseline vibration threshold from among a plurality of baseline vibration thresholds stored in the BVPS database 125 based on the stamping system data (i.e., the stamping system process identification data, the stamping system process cycle time data, and/or the stamping system process operational data). As an example, each of the plurality of baseline vibration thresholds stored in the BVPS database 125 is associated with a type of stamping process being performed and/or a type of workpiece 30. That is, each baseline vibration threshold is correlated with unique stamping system process identification data. As such, the vibration threshold selection module 120 selects the baseline vibration threshold from the baseline vibration profile selection database 125 that matches the obtained stamping system process identification data.

In one form, each of the baseline vibration thresholds stored in the BVPS database 125 defines an upper vibration threshold and lower vibration threshold for the given type of stamping process being performed and/or the type of workpiece 30. As an example, the upper vibration threshold may indicate a maximum amount of acceptable vibrational energy for the given type of stamping process being performed and/or the type of workpiece 30, and the lower vibration threshold may indicate a minimum amount of acceptable vibrational energy for the given type of stamping process being performed and/or the type of workpiece 30. It should be understood that the vibrational thresholds may correspond to other types of vibrational data threshold representations (e.g., coherence, amplitude, and/or frequency thresholds) and is not limited to the example described herein.

In one form, the frequency filter selection module 130 selects a frequency filter entry (hereinafter referred to as "frequency filter") from among a plurality of frequency filters stored in the frequency filter selection database 135 based on the stamping system data (i.e., the stamping system process identification data, the stamping system process cycle time data, and/or the stamping system process operational data). As an example, each of the plurality of frequency filters stored in the frequency filter selection database 135 is associated with a type of stamping process being performed and/or a type of workpiece 30. That is, each frequency filter is correlated with unique stamping system process identification data. As such, the frequency filter selection module 130 selects the frequency filter from the frequency filter selection database 135 that matches the obtained stamping system process identification data.

In one form, each of the frequency filters stored in the frequency filter selection database 135 defines a type of frequency filter to be applied to measured vibration values generated by the sensor data processing module 140 based on the given type of stamping process being performed and/or the type of workpiece 30. As an example, the frequency filter may include, a low-pass filter, a high-pass filter, a bandpass filter, among other filters. As used herein, a "low-pass filter" refers to a filter circuit that passes measured vibration values having a frequency value that are less than a lower cutoff threshold and attenuates measured vibration values having a frequency value that is greater than the lower cutoff threshold. As used herein, "high-pass filter" refers to a filter circuit that passes measured vibration values having a frequency value that are greater than an upper cutoff threshold and attenuates measured vibration values having a frequency value that are less than the lower cutoff threshold. As used herein, "bandpass filter" refers to a filter circuit that passes measured vibration values having a frequency value that are within an upper and lower bandpass threshold and attenuates measured vibration values having a frequency value that are not within the upper and lower bandpass threshold. In some forms, the upper and lower bandpass thresholds may correspond to the upper and lower cutoff thresholds, respectively.

Figure 3:
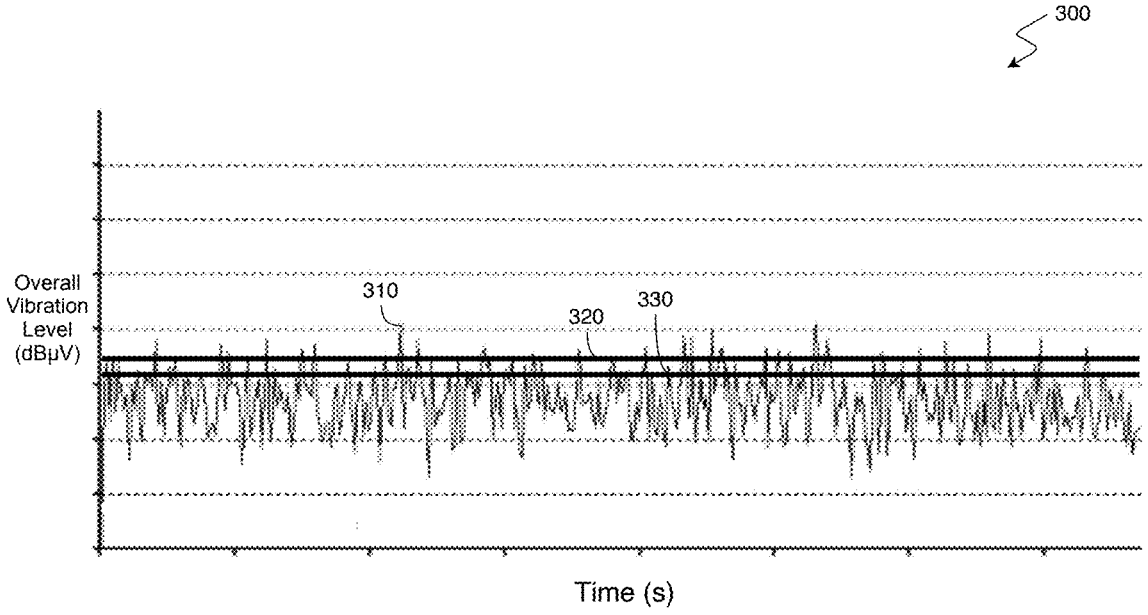
FIG. 3 illustrates an example vibration spectrum in accordance with the teachings of the present disclosure.

In one form, the sensor data processing module 140 generates a vibration spectrum comprising a plurality of measured vibration values based on the vibration data and the frequency filter selected by the frequency filter selection module 130. Each measured vibration value may be associated with a given iteration from among a plurality of iterations of the stamping process, and each measured vibration value may correspond to a measured vibrational energy of the associated conduit 40 for the given iteration. Each iteration may correspond to a discrete time value or a predefined time interval in which the vibration values are generated. As an example, and referring to FIGS. 2-3, the sensor data processing module 140 applies the selected low-pass filter, high-pass filter, or the bandpass filter and performs a Fast Fourier Transform (FFT) routine to attenuate one or more of the measured vibration values and generate a vibration spectrum 300, respectively. Furthermore, each measured vibration value 310 of the vibration spectrum 300 corresponds to a vibrational energy of the conduit 40 at a given time interval (as the iteration), and the vibrational energy may be a derivative of a root-mean-square (RMS) of the vibrational energy samples obtained during the time interval. It should be understood that other arithmetic representations of the vibrational energy of the conduit 40 at the given time interval may be employed and is not limited to the example described herein, such as a mean, median, minimum, maximum, root-mean-square value, among other arithmetic representations.

In one form, the conduit state module 150 determines whether the conduits 40 are in an obstructed state based on a comparison between a set of the measured vibration values of the measured vibration spectrum 300 and the selected baseline threshold. In one form, the set of measured vibration values includes one of the measured vibration values 310 (e.g., a most recent measured vibration value 310). In one form, the set of measured vibration values corresponds to a set of consecutive iterations from among a plurality of iterations of the stamping process (e.g., ten consecutive measured vibration values 310 associated with the ten most recent iterations of the stamping process).

As an example, the conduit state module 150 determines a number of the set of measured vibration values that deviate from an upper baseline vibration threshold 320 and a lower baseline vibration threshold 330 selected by the vibration threshold selection module 120. A given measured vibration value may deviate from the baseline vibration threshold when, for example, an absolute value of the difference between the baseline vibration thresholds 320, 330 and the measured vibration value is greater than a predefined difference. If the number of measured vibration values is greater than an alarm threshold, the conduit state module 150 determines that the conduit 40 is in the obstructed state. Otherwise, if the number is less than the alarm threshold, the conduit state module 150 determines that the conduit 40 is in the unobstructed state. In one form, the alarm threshold corresponds to predefined number of measured vibration values from among the set that is associated with an obstruction in a chute. The alarm threshold may be arbitrarily defined as a single value for each stamping process or may be correlated to the number of vibration values in the given set of measured vibration values (e.g., the alarm threshold is set to 60% of the number of measured vibration values in the set).

As a more specific example, the conduit state module 150 selects the ten most recent measured vibration values 310 from the vibration spectrum 300 (as the set of measured vibration values) and determines that seven of the ten most recent measured vibration values deviate from the baseline vibration thresholds 320, 330, as the absolute value of the difference the baseline vibration threshold and the seven measured vibration values are greater than the predefined difference. Accordingly, the conduit state module 150 may determine that one of the conduits 40 is in the obstructed state when, for example, the alarm threshold is six measured vibration values or less. Moreover, the conduit state module 150 may determine that one of the conduits 40 is in the unobstructed state when, for example, the alarm threshold is seven measured vibration values or greater.

In one form, the corrective action module 160 performs a corrective action in response to at least one of the conduits 40 being in the obstructed state. In one form, the corrective action includes broadcasting a notification (e.g., an alarm, an alert, among others) that indicates the conduits 40 are obstructed and/or discontinuing the stamping process. As an example, the corrective action module 160 may instruct an external or remote computing device (e.g., a visual display device, an audio device, a human machine interface (HMI), and/or a tactile feedback device provided within the stamping environment 5) to output an alarm in response to the conduits 40 being in the obstructed state. As another example, the corrective action may include broadcasting a command to the stamping system controller 70 to discontinue the stamping process to thereby enable an operator to remove the obstructions from the conduits 40.

In one form, the corrective action further includes adjusting one or more operational characteristics of the stamping process as indicated by the stamping system data. As an example and in response to the conduit state module 150 determining that one of the conduits 40 is in the obstructed state, the stamping system process operational data may also indicate that at least one of the die sensor data, temperature data, electrical data, and/or pressure data deviates from a corresponding nominal threshold. As such, the corrective action module 160 may broadcast a command to the stamping system controller 70 to calculate a new operational setpoint (e.g., operational electrical setpoint) and initiate a control routine, such as a proportional-integral-derivative (PID) or model predictive control (MPC) routine, to adjust the corresponding set of operational data to approach the new operational setpoint.

Figure 4:
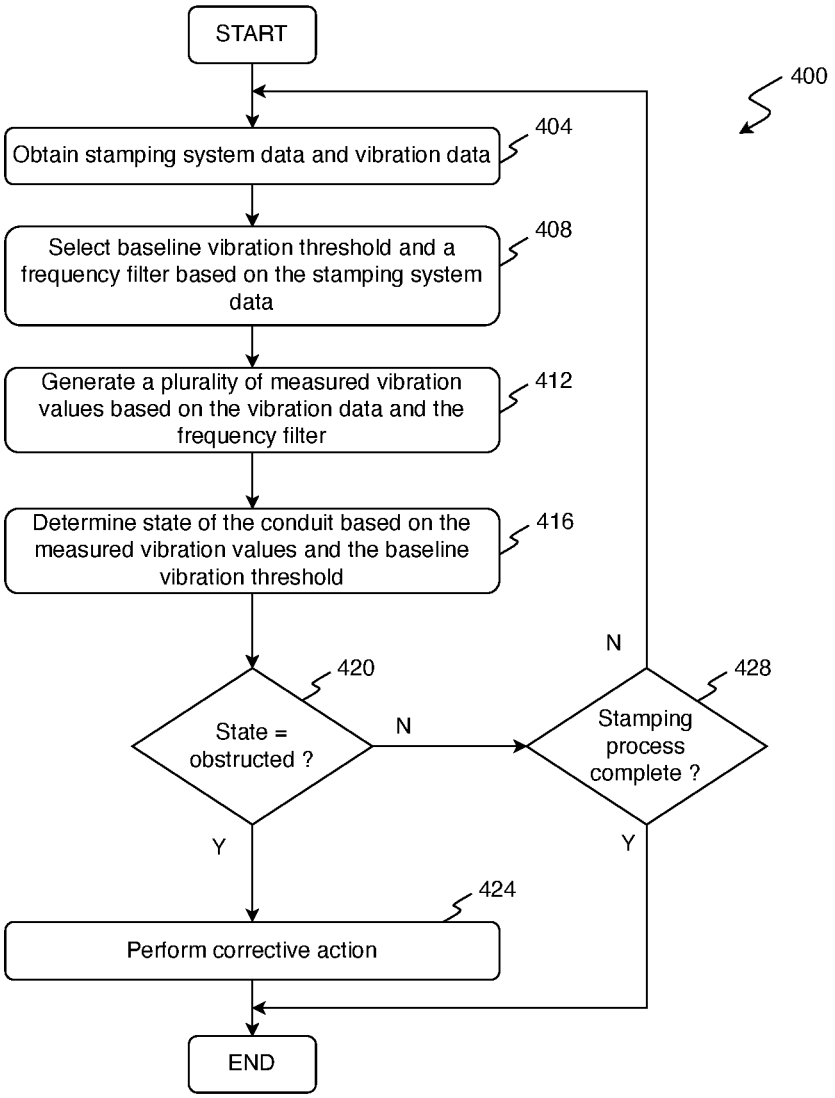
FIG. 4 is a flowchart illustrating an example control routine for monitoring obstructions of a conduit of a stamping environment in accordance with the teachings of the present disclosure.

Referring to FIG. 4, a flowchart illustrating an example routine 400 for monitoring obstructions of the conduits 40 of the stamping environment 5 is shown. At 404, the vibration monitoring controller 100 obtains the stamping system data from the stamping system controller 70 and the vibration data from the one or more vibration sensors 50. At 408, the vibration monitoring controller 100 selects a baseline vibration threshold and a frequency filter based on the stamping system data (e.g., the stamping system process identification data). At 412, the vibration monitoring controller 100 generates a plurality of measured vibration values based on the vibration data and the selected frequency filter (e.g., the vibration spectrum 300). At 416, the vibration monitoring controller 100 determines the state of the conduits 40 based on the measured vibration values and the selected baseline vibration threshold. At 420, the vibration monitoring controller 100 determines whether the state of one of the conduits 40 is in the obstructed state. If so, the routine 400 proceeds to 424, where the vibration monitoring controller 100 performs a corrective action. Otherwise, the routine 400 proceeds to 428, where the vibration monitoring controller 100 determines whether the stamping process is complete. If so, the routine 400 ends. Otherwise, the routine 400 proceeds to 404.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

In this application, the term "controller" and/or "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components (e.g., op amp circuit integrator as part of the heat flux data module) that provide the described functionality; or a combination of some or all of the above, such as in a system-on-chip.

The term memory is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general-purpose computer to execute one or more particular functions embodied in computer programs. The functional blocks, flowchart components, and other elements described above serve as software specifications, which can be translated into the computer programs by the routine work of a skilled technician or programmer.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method for monitoring obstructions of a conduit of a stamping environment, the method comprising:

obtaining stamping system data from a stamping system data controller and vibration data from one or more vibration sensors disposed at the conduit, wherein the conduit is one of a chute and an evacuation tube;

selecting a baseline vibration threshold and a frequency filter from among a plurality of frequency filters based on the stamping system data;

generating a plurality of measured vibration values based on the vibration data and the frequency filter, wherein each measured vibration value from among the plurality of measured vibration values is associated with a given iteration from among a plurality of iterations of a stamping process;

determining whether the conduit is in an obstructed state based on a comparison between a set of measured vibration values from among the plurality of measured vibration values and the baseline vibration threshold; and performing a corrective action in response to the conduit being in the obstructed state.

2. The method of claim 1, wherein the stamping system data includes stamping system process identification data.

3. The method of claim 2, wherein the stamping system data includes stamping system process cycle time data, stamping system process operational data, or a combination thereof.

4. The method of claim 1, wherein the frequency filter is one of a low-pass filter, a high-pass filter, and a bandpass filter.

5. The method of claim 1, wherein each measured vibration value from among the plurality of measured vibration values corresponds to a measured vibrational energy of the conduit at the given iteration of the stamping process.

6. The method of claim 5, wherein the measured vibrational energy is a derivative of a root-mean-square (RMS) of a plurality of vibrational energy values of the conduit at the given iteration.

7. The method of claim 1, wherein the set of measured vibration values correspond to a set of consecutive iterations from among the plurality of iterations of the stamping process.

8. The method of claim 1, wherein determining whether the conduit is in the obstructed state based on the comparison between the set of measured vibration values and the baseline vibration threshold further comprises:

determining a number of the set of measured vibration values that deviate from the baseline vibration threshold;

determining whether the number is greater than an alarm threshold; and determining the conduit is in the obstructed state in response to the number being greater than the alarm threshold.

9. The method of claim 1, wherein performing the corrective action includes broadcasting a notification, discontinuing the stamping process, or a combination thereof.

10. The method of claim 9, wherein the corrective action is further based on the stamping system data.

11. A system for monitoring obstructions of a conduit of a stamping environment, the system comprising:

one or more processors and one or more nontransitory computer-readable mediums comprising instructions that are executable by the one or more processors, wherein the instructions include:

obtaining stamping system process identification data from a stamping system data controller and vibration data from one or more vibration sensors disposed at the conduit, wherein the conduit is one of a chute and an evacuation tube;

selecting a baseline vibration threshold and a frequency filter from among a plurality of frequency filters based on the stamping system process identification data;

generating a plurality of measured vibration values based on the vibration data and the frequency filter, wherein each measured vibration value from among the plurality of measured vibration values is associated with a given iteration from among a plurality of iterations of a stamping process;

determining whether the conduit is in an obstructed state based on a comparison between a set of measured vibration values from among the plurality of measured vibration values and the baseline vibration threshold; and performing a corrective action in response to the conduit being in the obstructed state.

12. The system of claim 11, wherein each measured vibration value from among the plurality of measured vibration values corresponds to a measured vibrational energy of the conduit at the given iteration of the stamping process.

13. The system of claim 12, wherein the measured vibrational energy is a derivative of a root-mean-square (RMS) of a plurality of vibrational energy values of the conduit at the given iteration.

14. The system of claim 11, wherein the set of measured vibration values correspond to a set of consecutive iterations from among the plurality of iterations of the stamping process.

15. The system of claim 11, wherein the instructions for determining whether the conduit is in the obstructed state based on the comparison between the set of measured vibration values and the baseline vibration threshold further comprise:

determining a number of the set of measured vibration values that deviate from the baseline vibration threshold;

determining whether the number is greater than an alarm threshold; and determining the conduit is in the obstructed state in response to the number being greater than the alarm threshold.

16. The system of claim 11, wherein the instructions for performing the corrective action includes broadcasting a notification, discontinuing the stamping process, or a combination thereof.

17. The system of claim 11, wherein the corrective action is further based on the stamping system data.

18. A method for monitoring obstructions of a conduit of a stamping environment, the method comprising:

obtaining stamping system process identification data from a stamping system data controller and vibration data from one or more vibration sensors disposed at the conduit, wherein the conduit is one of a chute and an evacuation tube;

selecting a baseline vibration threshold and a frequency filter from among a plurality of frequency filters based on the stamping system process identification data;

generating a plurality of measured vibration values based on the vibration data and the frequency filter, wherein each measured vibration value from among the plurality of measured vibration values is associated with a given iteration from among a plurality of iterations of a stamping process;

determining whether the conduit is in an obstructed state based on a comparison between a set of measured vibration values from among the plurality of measured vibration values and the baseline vibration threshold, wherein the set of measured vibration values correspond to a set of consecutive iterations from among the plurality of iterations of the stamping process; and performing a corrective action in response to the conduit being in the obstructed state.

19. The method of claim 18, wherein:

each measured vibration value from among the plurality of measured vibration values corresponds to a measured vibrational energy of the conduit at the given iteration of the stamping process; and the measured vibrational energy is a derivative of a root-mean-square (RMS) of a plurality of vibrational energy values of the conduit at the given iteration.

20. The method of claim 18, wherein determining whether the conduit is in the obstructed state based on the comparison between the set of measured vibration values and the baseline vibration threshold further comprises:

determining a number of the set of measured vibration values that deviate from the baseline vibration threshold;

determining whether the number is greater than an alarm threshold; and determining the conduit is in the obstructed state in response to the number being greater than the alarm threshold.

* * * * *